US006795026B2

(12) United States Patent
Chiu et al.

(10) Patent No.: US 6,795,026 B2
(45) Date of Patent: Sep. 21, 2004

(54) DUAL-BAND FR4 CHIP ANTENNA

(75) Inventors: Tsung-Wen Chiu, Taipei (TW); Yuan-Tung Cheng, Kaohsiung (TW); Kin-Lu Wong, Kaohsiung (TW)

(73) Assignees: Accton Technology Corporation, Hsinchu (TW); Kin-Lu Wong, Kaohsiung (TW)

( * ) Notice: Subject to any disclaimer, the term of this patent is extended or adjusted under 35 U.S.C. 154(b) by 76 days.

(21) Appl. No.: 10/006,474

(22) Filed: Dec. 5, 2001

(65) Prior Publication Data

US 2003/0103007 A1 Jun. 5, 2003

(51) Int. Cl.[7] ..... H01Q 1/24
(52) U.S. Cl. ..... 343/702; 343/700 MS
(58) Field of Search ..... 343/702, 700 MS, 343/895, 873; H01Q 1/24

(56) References Cited

U.S. PATENT DOCUMENTS 5,870,066 A * 2/1999 Asakura et al. ..... 343/895
6,107,970 A * 8/2000 Holshouser et al. ..... 343/702
6,198,442 B1 * 3/2001 Rutkowski et al. ..... 343/702
6,229,487 B1 * 5/2001 Sadler et al. ..... 343/700 MS
2003/0001793 A1 * 1/2003 Park ..... 343/702

* cited by examiner

*Primary Examiner*—Hoanganh Le
(74) *Attorney, Agent, or Firm*—Harness, Dickey & Pierce P.L.C.

(57) ABSTRACT

A dual-band FR4 chip antenna is disclosed. The present invention forms a meandering radiating metal line on a low-cost FR4 chip base, thereby achieving a dual-band operation. The present invention comprises: an FR4 chip base made of an FR4 material; a meandering radiating metal line; and a connecting point, wherein the meandering radiating metal line is formed on at least two surfaces of the FR4 chip base, and the connecting point is used for connecting the meandering radiating metal line to a signal transmission line. The present invention can cover two ISM (Industrial-Scientific-Medical) bands, such as those around 2450 MHz and 5800 MHz. The FR4 chip antenna in the present invention is not only easy to be integrated with microwave circuits, but also sturdy and cheap, and is further suitable for using the surface-mounting technology (SMT) to perform a mass production. In addition, the present invention has two separate wide bandwidths, and is suitable for dual-band operation. Therefore, the present invention has considerably high industrial application value.

13 Claims, 10 Drawing Sheets

DUAL-BAND FR4 CHIP ANTENNA

FIELD OF THE INVENTION

The present invention relates to a dual-band FR4 chip antenna, and more particularly, to a dual-band chip antenna fabricated by forming a meandering radiating metal line on a chip base made of an FR4 material.

BACKGROUND OF THE INVENTION

As communication technologies have been growing prosperously, various applications on the communication technologies have also been appeared in the market dramatically. In addition, the IC technologies have become more matured, so that the products can be made smaller and smaller. As to an antenna used for radiating and receiving signals in communication products, it plays a very important role in deciding if the products can achieve the goal of small size.

An antenna is an element used for radiating or receiving an electromagnetic wave. Generally, characteristics of an antenna can be determined by the parameters of radiation pattern, return loss and antenna gain. Nowadays, antennas need to have the features of small size, good performance and low cost in order to be popularly accepted by the market. According to the locations where antennas are mounted, the antennas can be classified into two categories, which are a built-in type and an external type. For the sake of appearance, the built-in typed antennas have gradually replaced the external-typed antennas. On the other hand, the surface mounting technology (SMT) that can be utilized for mass production has been quite matured. Hence, chip antennas that are suitable for using the SMT become one of the most popular designs for the built-in typed antennas, since the cost of packaging and connection thereof can be greatly reduced.

However, a conventional chip antenna is usually made of a ceramic material, and the ceramic material has the shortcomings of being expensive and fragile, so that the cost for making the ceramic chip antenna is high and the ceramic antenna is further not endurable due to its fragility. Therefore, there is an urgent need in developing a low-cost and sturdy chip antenna for: overcoming the shortcomings of the ceramic chip antenna; lowering the cost for integrating with microwave circuits; and further enhancing the product stability.

SUMMARY OF THE INVENTION

Just as described above, the conventional ceramic chip antenna is not only expensive but also fragile, causing the end product to be expensive and unendurable. Hence, the conventional ceramic chip antenna cannot be applied broadly in various products.

Therefore, it is a main object of the present invention to provide a dual-band FR4 chip antenna to replace the conventional ceramic chip antenna by using an FR4 material that is low in cost and sturdy, and to design a chip antenna having the features of low cost, good performance and sturdiness, wherein the chip antenna can be fabricated in different patterns and forms in accordance with actual needs, and various antenna resonant frequencies and frequency ratios can be obtained by properly adjusting the length of the meandering radiating metal line and the meandering pattern in which the meandering radiating metal line is formed, thereby satisfying all kinds of communication systems.

It is the other object of the present invention to provide a dual-band FR4 chip antenna to be suitable for using the SMT, so that the chip antenna can be massively produced, thereby lowering the cost for integrating with microwave circuits and further enhancing the product stability.

In accordance with the aforementioned objects of the present invention, the present invention provides a dual-band FR4 chip antenna, and the dual-band FR4 chip antenna comprises: an FR4 chip base made of an FR4 material; a meandering radiating metal line; and a connecting point, wherein the meandering radiating metal line is formed on at least two surfaces of the FR4 chip base, and is the major portion used by the antenna for radiating an electromagnetic wave, and the total length of the meandering radiating metal line is about ¼ λ (wavelength) of the central frequency in the antenna's first operating band; and the connecting point is used for connecting the meandering radiating metal line to a signal transmission line, wherein the signal transmission line is used for conveying a signal for the system. The present invention can obtain dual-frequency operation with various frequency ratios by properly adjusting the length of the meandering radiating metal line and the meandering pattern in which the meandering radiating metal line is formed. Further, the dual-band FR4 chip antenna of the present invention is mounted on a microwave substrate having a ground surface used for connecting the signal ground terminal.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention discloses a dual-band FR4 chip antenna. The dual-band FR4 chip antenna of the present antenna is to form a meandering radiating metal line on an FR4 chip base having the advantages of low price and sturdiness, and to obtain two separate desired resonant frequencies by adjusting the length and pattern of the meandering radiating metal line, thereby obtaining a dual-band operation. Hence, the dual-band FR4 chip antenna of the present antenna can overcome the disadvantages of the conventional ceramic chip antenna, which is expensive and fragile.

Figure 1:
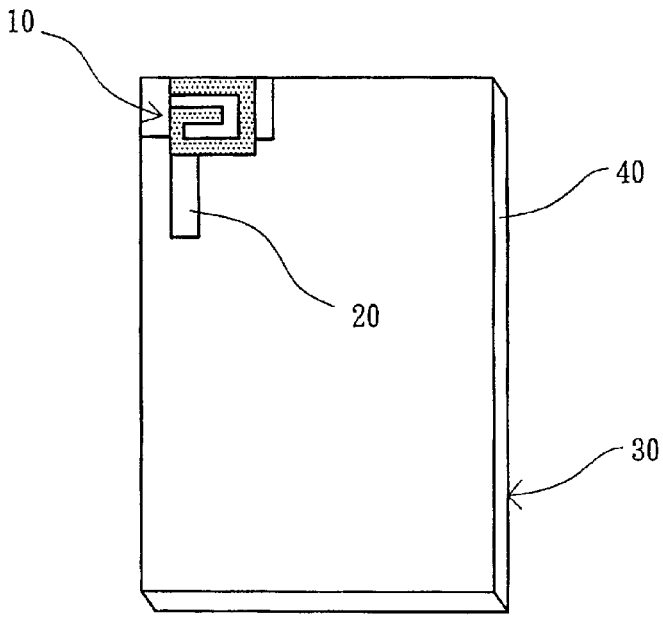
FIG. 1 is a schematic diagram showing a dual-band FR4 chip antenna mounted on a microwave substrate, according to a preferred embodiment of the present invention.

Referring to FIG. 1, FIG. 1 is a schematic diagram showing a dual-band FR4 chip antenna mounted on a microwave substrate, according to a preferred embodiment of the present invention. A dual-band FR4 chip antenna 10 is mounted on a microwave substrate 40 having a ground surface 30, and the ground surface 30 contacts the signal ground terminal. The size of microwave substrate 40 is, for example, about 100×35 $mm^2$, and the ground surface 30 does not cover a portion of the area underneath the dual-band FR4 chip antenna 10 on the microwave substrate 40, and the size of the portion is, for example, about 9×5 $mm^2$. The microwave substrate 40 can be considered as an electrical circuit board of a practical wireless cellular phone; that is, the proposed dual-band FR4 chip antenna is applied in a wireless cellular phone for achieving Bluetooth or wireless local area network (LAN) operation. Besides, a signal transmission line 20 is used for conveying a signal for the system, and can be, for example, a mircostrip transmission line, coaxial feeding line, or other electromagnetic signal transmission lines.

Figure 2:
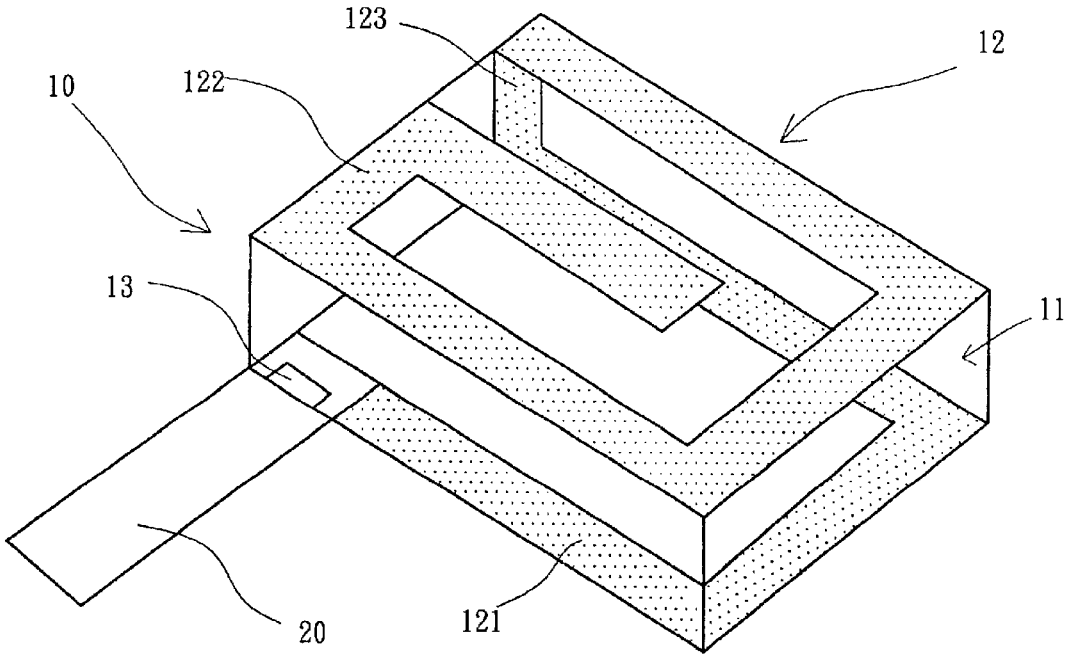
FIG. 2 is a schematic diagram showing the structure of a dual-band FR4 chip antenna, according to a preferred embodiment of the present invention.

Referring to FIG. 2, FIG. 2 is a schematic diagram showing the structure of a dual-band FR4 chip antenna, according to a preferred embodiment of the present invention. As shown in FIG. 2, the dual-ban FR4 chip antenna 10 comprises: an FR4 chip base 11; a meandering radiating metal line 12; and a connecting point 13. The connecting point 13 is used for connecting the meandering radiating metal line 12 to a signal transmission line 20, and the signal at transmission line 20 is used for conveying a signal for the system. The FR4 chip base 11 is a square prism made of an FR4 material, and the dielectric constant thereof is between about 4 to about 5. The thickness of the FR4 chip base 11 cannot be too small; otherwise the bandwidth of the antenna will be significantly affected. The thickness of the FR4 chip base 11 of the present invention is, for example, about 1.6 mm, and can be as small as about 0.8 mm if necessary. The meandering radiating metal line 12 is formed on at least two surfaces of the FR4 chip base 11, and is the major portion that is used by the dual-band FR4 chip antenna 10 for radiating an electromagnetic wave. The meandering radiating metal line 12 can be made of any conductors, such a silver, copper, etc. The meandering radiating metal line 12 further comprises: a first segment 121 located on the lower surface of the FR4 chip base 11; a second segment 122 located on the upper surface of the FR4 chip base 11; and a connecting segment 123 located on one side of the FR4 chip base 11 for connecting the first segment 121 and the second segment 122. From the design point of view, the total length of the meandering radiating metal line 12 is about ¼λ (wavelength) of the central frequency in the antenna's first operating band. For example, with a 2450 MHz central frequency, the total length of the meandering radiating metal line 12 is about 35 mm. The size of FR4 chip base 11 of a preferred embodiment of the present invention is about 6×6×1.6 mm3, and the first and second operating bands of dual-band FR4 chip antenna 10 are around the first two resonant frequencies of the meandering radiating metal line. The first operating frequency can be adjusted by changing the total length of the meandering radiating metal line 12. On the other hand, the variation of the width of the meandering radiating metal line 12 can be used for adjusting the frequency ratio between the first and second resonant frequencies; for example, the width thereof can be arranged in a pattern gradually from being narrow to wide. The meandering radiating metal line 12 does not have to be a fixed width from the starting end to the finishing end, i.e. it can have a plurality of widths. Hence, through different designs of length, width and pattern of the meandering radiating metal line 12, the desire two separate operating frequencies can be achieved quite easily.

Figure 3:
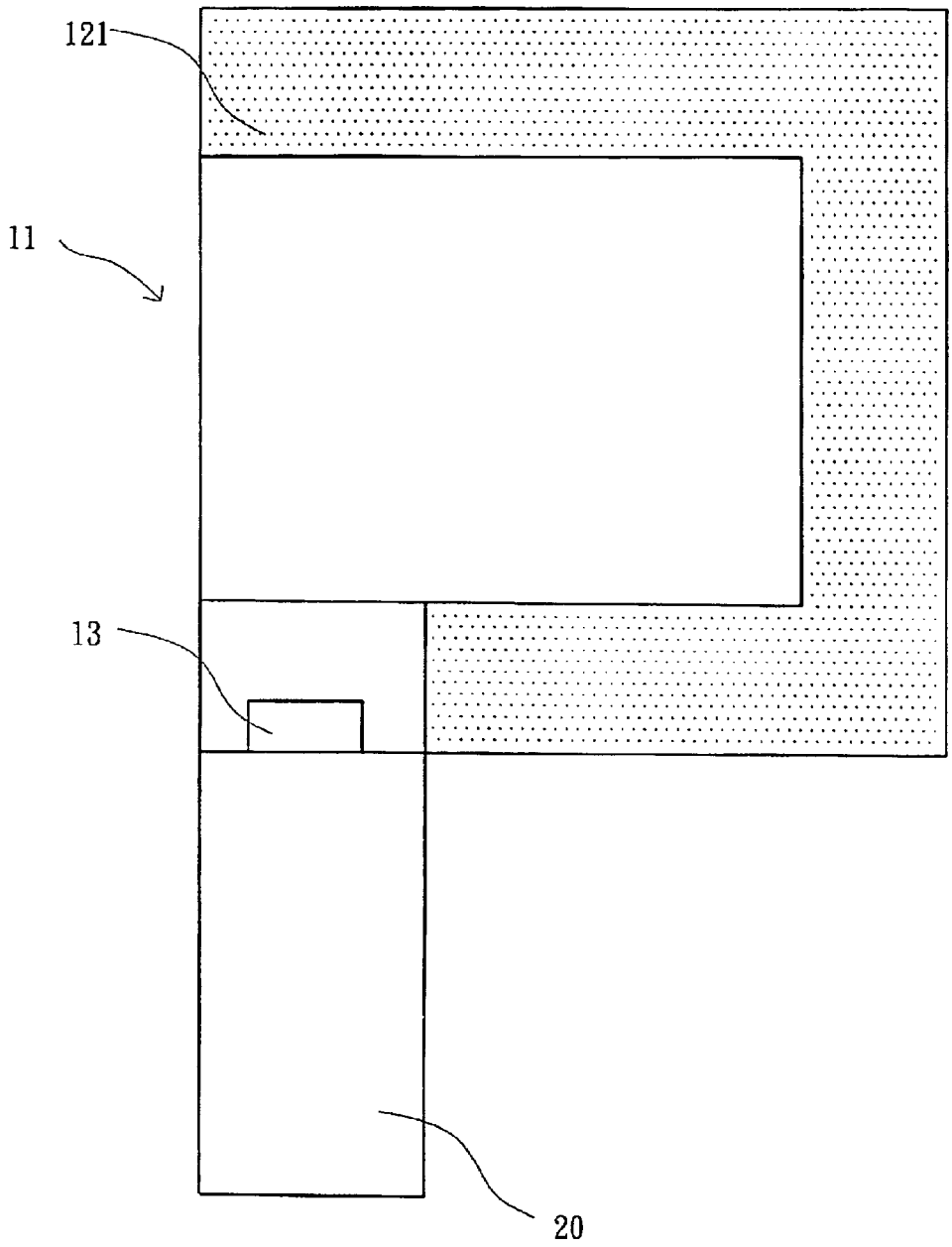
FIG. 3 is a schematic bottom view of a dual-band FR4 chip antenna of a preferred embodiment of the present invention.
Figure 4:
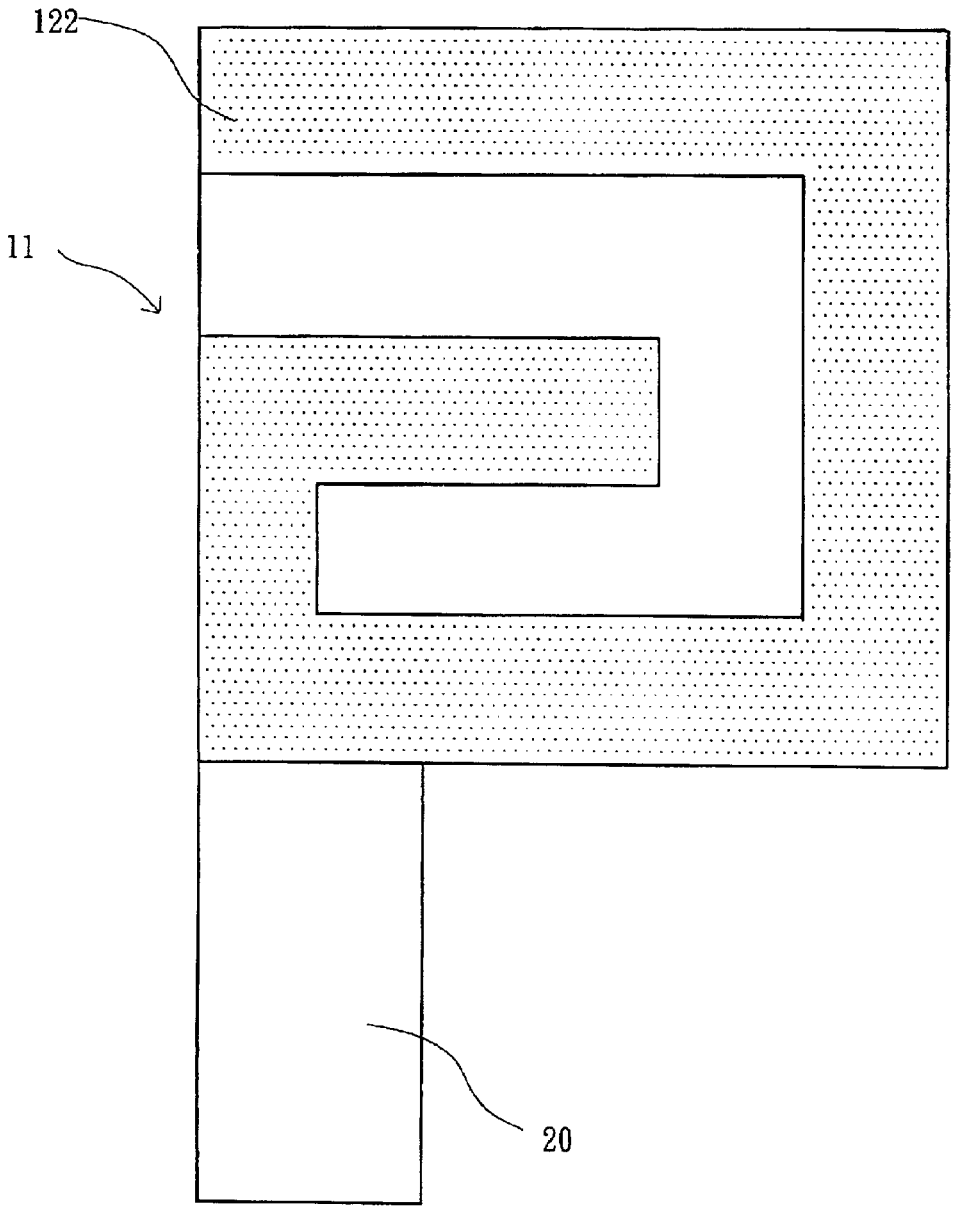
FIG. 4 is a schematic top view of a dual-band FR4 chip antenna of a preferred embodiment of the present invention.
Figure 5:
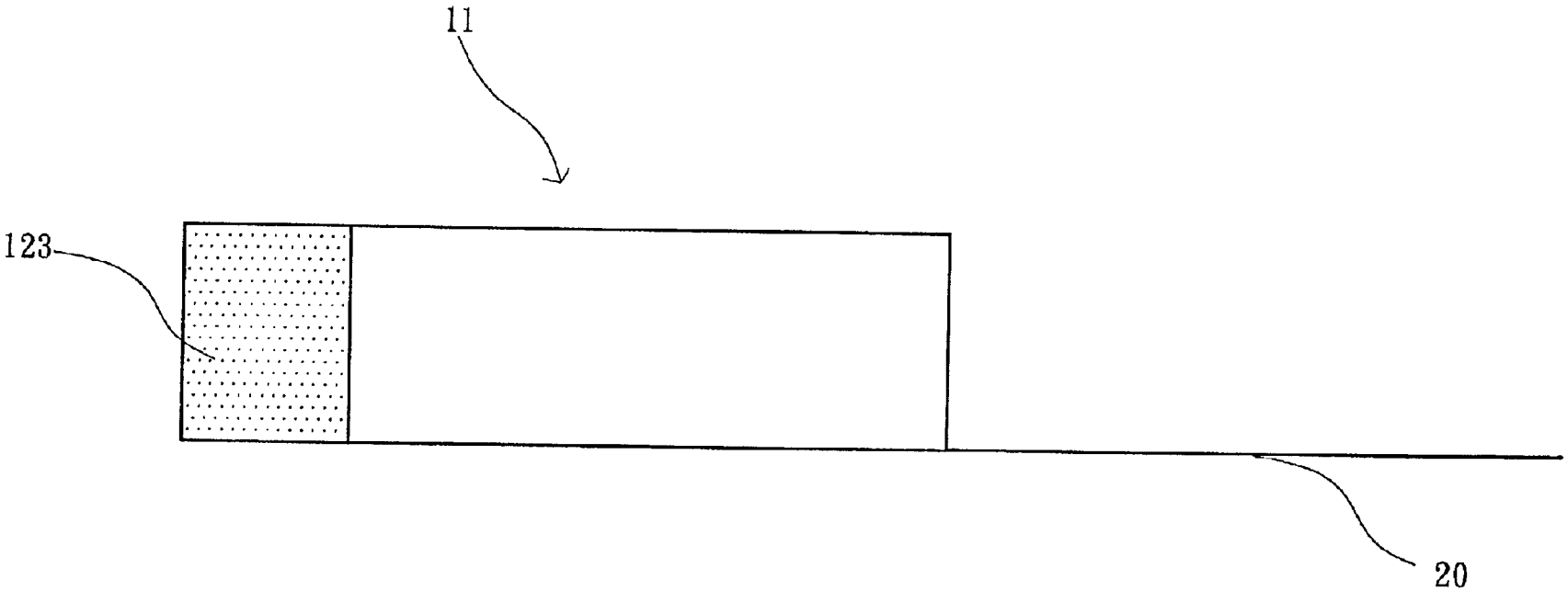
FIG. 5 is a schematic side view of a dual-band FR4 chip antenna of a preferred embodiment of the present invention.

Referring to FIG. 3 to FIG. 5, FIG. 3 is a schematic bottom view of a dual-band FR4 chip antenna of a preferred embodiment of the present invention, and FIG. 4 is a schematic top view of a dual-ba FR4 chip antenna of a preferred embodiment of the present invention, and FIG. 5 is a schematic side view of a dual-band FR4 chip antenna of a preferred embodiment of the resent invention. As shown in FIG. 3, the first segment 121 has is a substantially U-shaped segment having one end connected to one end of the connecting segment 123, and the other end connected to the transmission line 20 and the first segment 121 is composed of three metal lines, a first lower horizontal line; a lower vertical line; and a second lower horizontal line, meandering along three sides of FR4 chip base 11, and the portion of microwave substrate 40 contacting the first lower horizontal line of the first segment 121 is covered with the ground surface 30, wherein the first lower horizontal line is at the beginning of first segment 121 and usually is vertical to the signal transmission line 20. Thereafter, the first lower vertical line of the first segment 121 is vertically connected to the first lower horizontal line, and the second lower horizontal line is vertically connected to the first lower vertical line. As shown in FIG. 4, the second segment 122 comprises a substantially U-shaped segment having one end connected to the other end of the connecting segment 123; and a substantially L-shaped segment on the same surface plane of the U-shaped segment of the second segment 122, having one end connected to the other end of the U-shaped segment of the second segment 122, and the second segment 122 is composed of three horizontal lines and two vertical lines, which are formed sequentially that; the first upper horizontal line is formed first; then the first upper vertical line; then the second upper horizontal line; then the second upper vertical line, wherein the second upper vertical line is only extended to about the middle point of one side of the upper surface of the FR4 chip base 11; and thereafter the third upper horizontal line is formed, wherein the third upper horizontal line is shorter than the first and second upper horizontal lines, so that it does not contact the first upper vertical line. Therefore, the meandering pattern of the metal lines of the present preferred embodiment can meet the demand of small-sized antenna.

Figure 6:
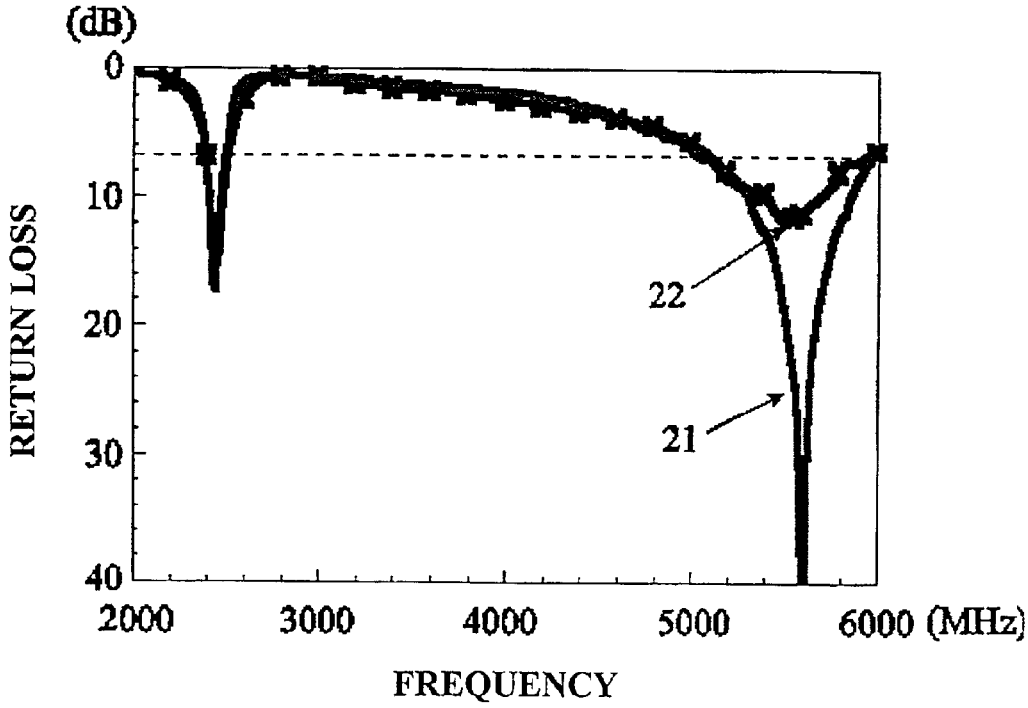
FIG. 6 is a diagram showing curves of simulation and experimental results of return loss vs. frequency, according to a dual-band FR4 chip antenna of a preferred embodiment of the present invention.

Just as the aforementioned description, the dual-band FR4 chip antenna of a preferred embodiment of the present invention can be operated at 2450 MHz (the first operating frequency) and 5800 MHz (the second operating frequency). Referring to FIG. 6, FIG. 6 is a diagram showing curves of simulation and experimental results of return loss vs. frequency, according to a dual-band FR4 chip antenna of a preferred embodiment of the present invention. As shown in FIG. 6, curve 21 and curve 22 are quite coincident with each other, and the bandwidths thereof are about 105 MHz and 820 MHz, respectively, wherein curve 21 is an experimental result, and curve 22 is a simulation result obtained by using the electromagnetic simulation software HFSS. A dotted lined in FIG. 6 is a reference value for the present preferred embodiment, and the reference return loss shown is about 7.3 dB, which is equivalent to about 1:2.5 VSWR (voltage standing wave ratio).

Figure 7:
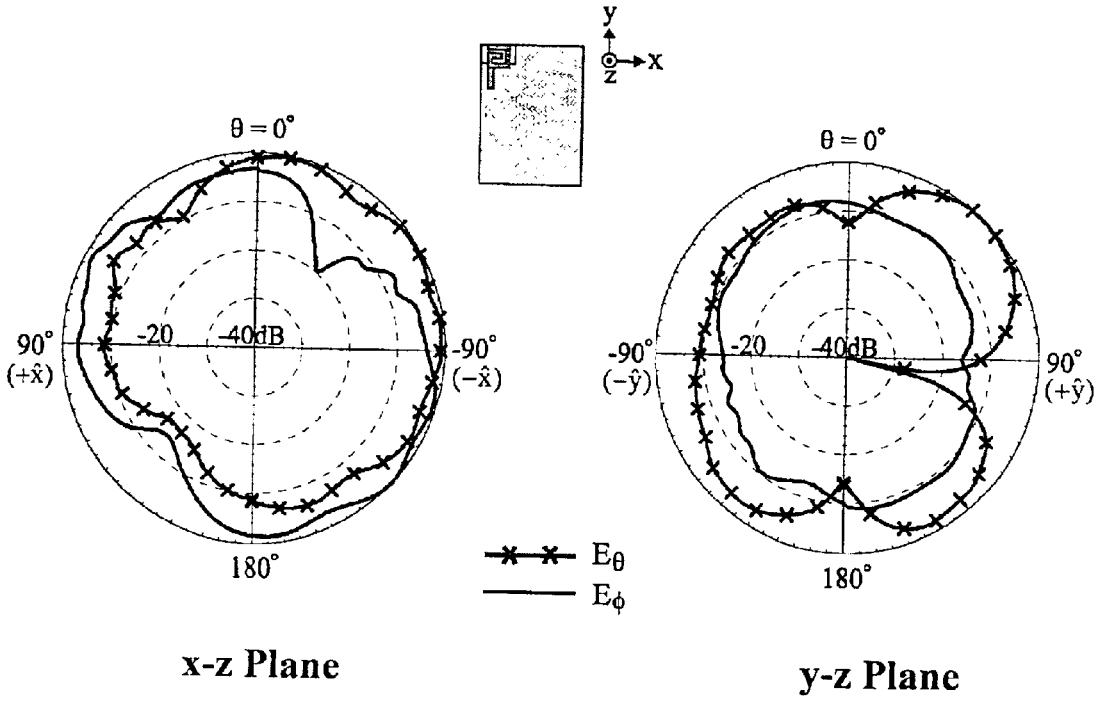
FIG. 7 is a diagram showing measured radiation patterns, when a dual-band FR4 chip antenna of a preferred embodiment of the present invention is operated at 2450 MHz.
Figure 8:
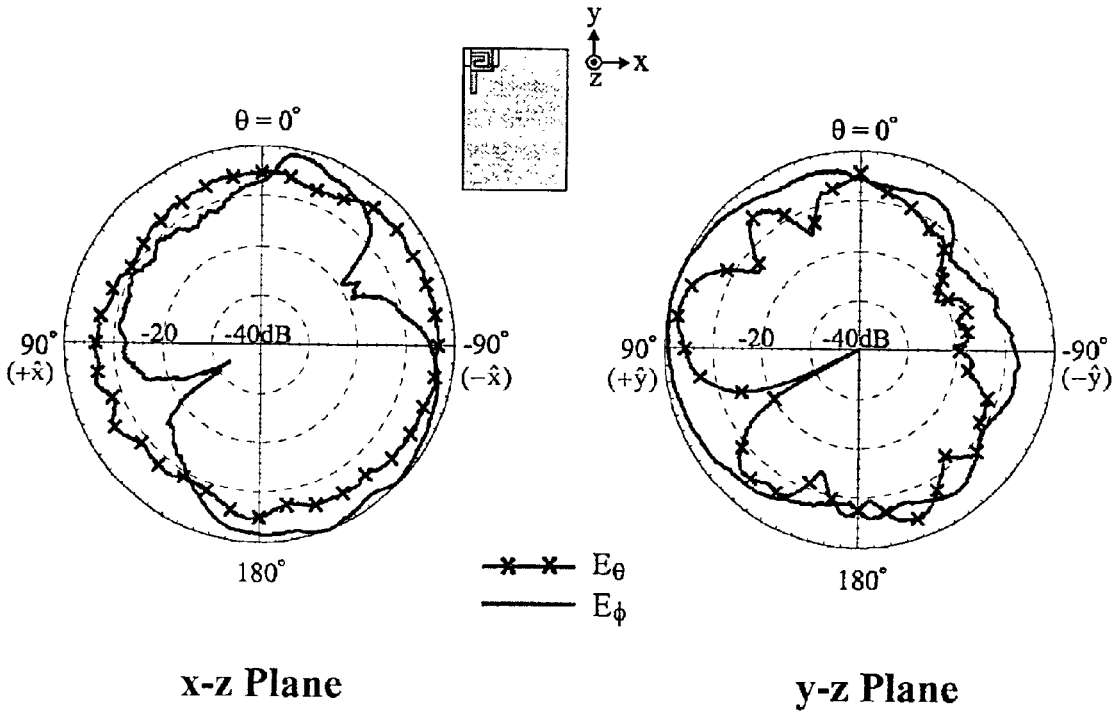
FIG. 8 is a diagram showing measured radiation patterns, when a dual-band FR4 chip antenna of a preferred embodiment of the present invention is operated at 5800 MHz.
Figure 9:
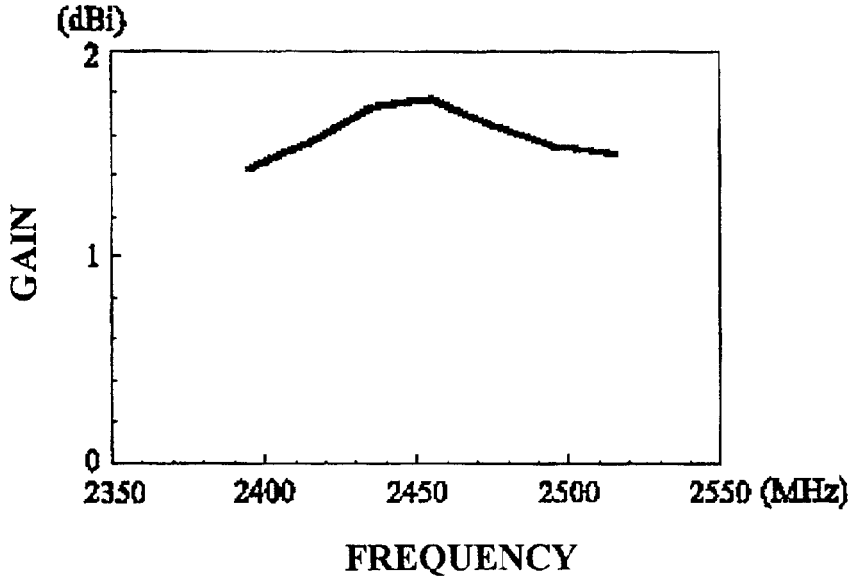
FIG. 9 is a diagram showing a curve of measured antenna gain vs. frequency, when a dual-band FR4 chip antenna of a preferred embodiment of the present invention is operated in the 2450-MHz band.
Figure 10:
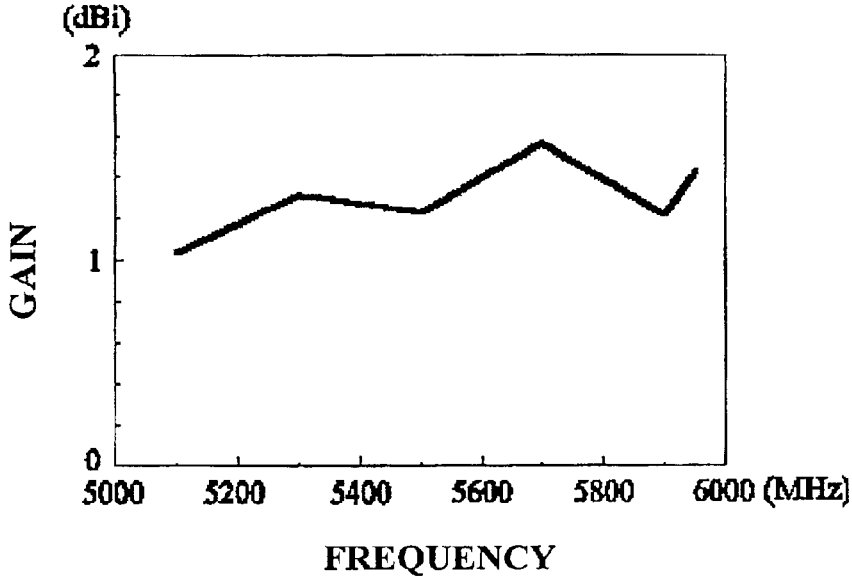
FIG. 10 is a diagram showing a curve of measured antenna gain vs. frequency, when a dual-band FR4 chip antenna of a preferred embodiment of the present invention is operated in the 5800-MHz band.

Referring to FIG. 7 and FIG. 8, FIG. 7 is a diagram showing measured radiation patterns, when a dual-band FR4 chip antenna of a preferred embodiment of the present invention is operated at 2450 MHz, and FIG. 8 is a diagram showing measured radiation patterns, when a dual-band FR4 chip antenna of a preferred embodiment of the present invention is operated at 5800 MHz. Referring to FIG. 9 and FIG. 10, FIG. 9 is a diagram showing a curve of measured antenna gain vs. frequency, when a dual-band FR4 chip antenna of a preferred embodiment of the present invention is operated in the 2450-MHz band, and FIG. 10 is a diagram showing a curve of measured antenna gain vs. frequency, when a dual-band FR4 chip antenna of a preferred embodiment of the present invention is operated in the 5800-MHz band. It can be known from the figures that the antenna gain of the present preferred embodiment is from about 1 dBi to about 2 dBi while operated at between about 2380 MHz and about 2500 MHz, and also is from about 1 dBi to about 2 dBi while operated at between about 5100 MHz and about 5900 MHz, To sum up, the dual-band FR4 chip antenna of a preferred embodiment of the present invention can provide sufficient coverage for both bandwidths around 2450 MHz and 5800 MHz with good antenna gain, wherein those two bandwidths are the ones popularly utilized in the ISM (Industrial-Scientific-Medical) band. Therefore, the dual-band FR4 chip antenna of the present invention is very suitable for use in Bluetooth or wireless LAN system.

Figure 11:
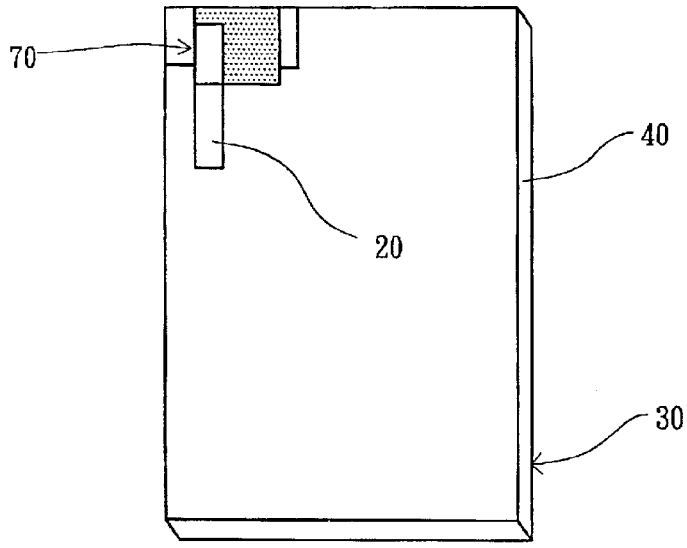
FIG. 11 and FIG. 13 are schematic diagrams each of which shows a dual-band FR4 chip antenna mounted on a microwave substrate, according to the other preferred embodiments of the present invention.
Figure 12:
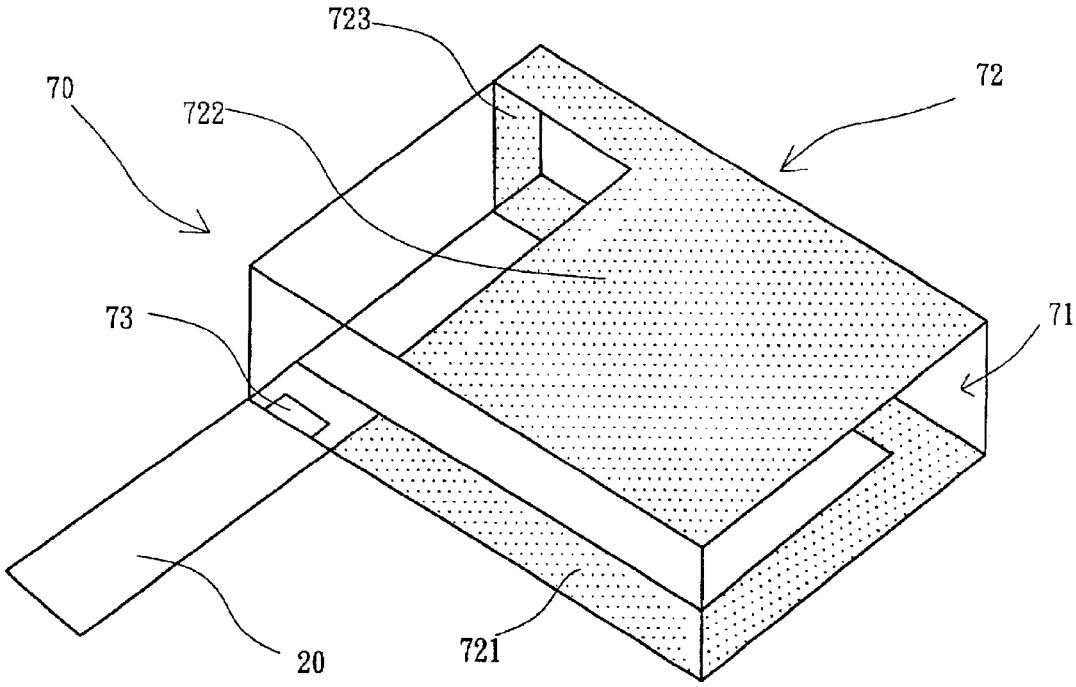
FIG. 12 and FIG. 14 are schematic diagrams each of which shows the structure of a dual-band FR4 chip antenna according to the other preferred embodiments of the present invention.
Figure 13:
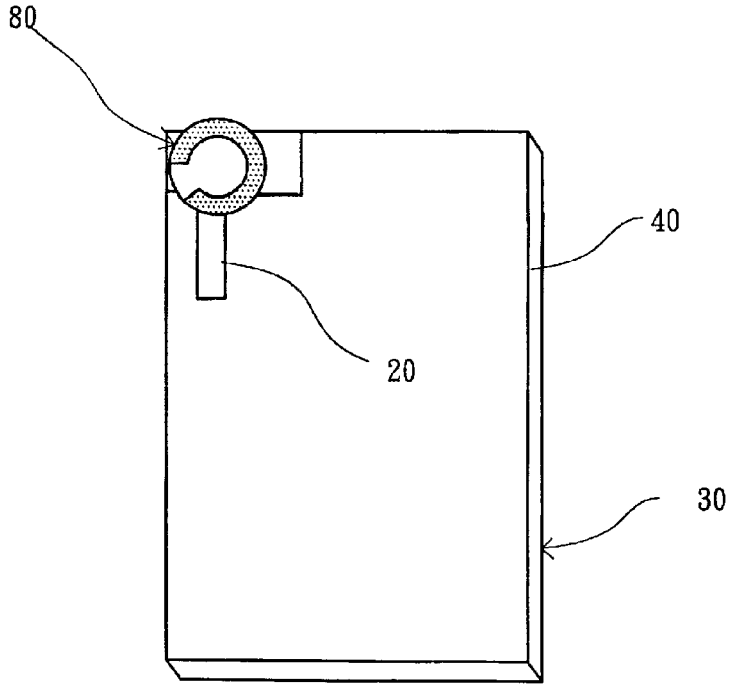
Figure 14:
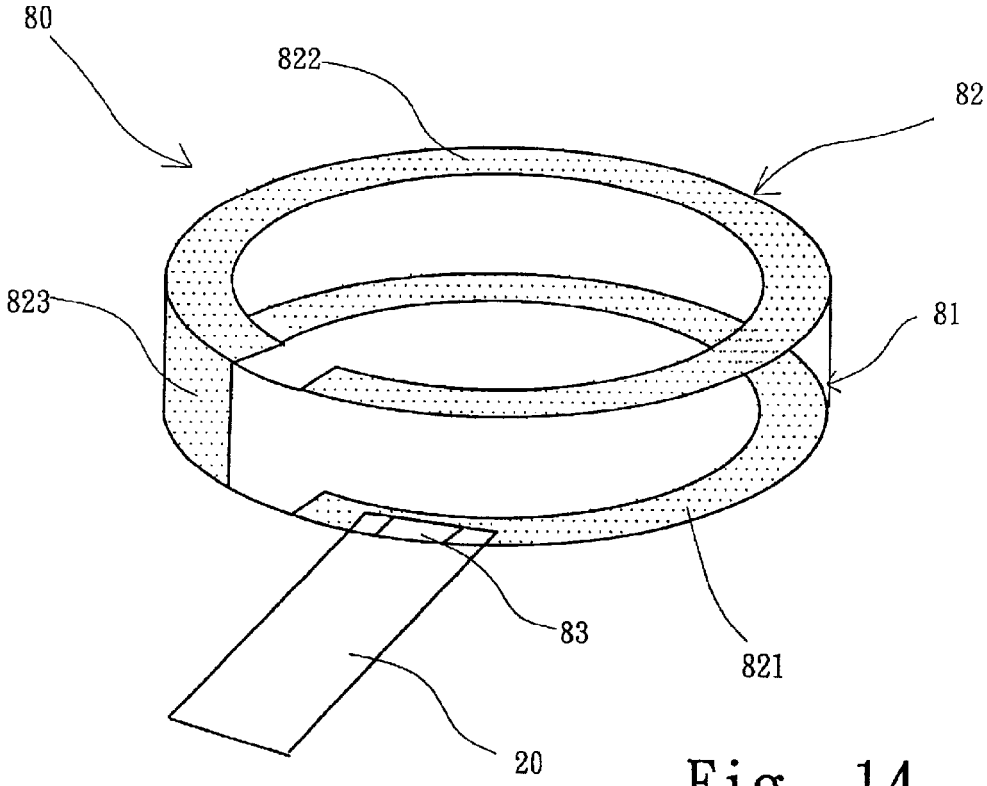

Besides, the FR4 chip base 11 as shown in FIG. 2 can also be selected from a group consisting of a rectangular prism, a square prism and a cylinder, and the meandering radiating metal line 12 can be formed in various patterns. Referring to FIGS. 11 to 14, FIG. 11 and FIG. 13 are schematic diagrams each of which shows a dual-band FR4 chip antenna mounted on a microwave substrate, according to the other preferred embodiments of the present invention, and FIG. 12 and FIG. 14 are schematic diagrams each of which shows the structure of a dual-band FR4 chip antenna according to the other preferred embodiments of the present invention. FIG. 11 and FIG. 12 illustrate an FR4 chip base 71 which has a different pattern of a meandering radiating metal line 72 from that shown in FIG. 2. The meandering radiating metal line 72 is formed on at least two surfaces of the FR4 chip base 71, and further comprises: a lower metal line 721; an upper metal line 722; and a connecting metal line 723. FIG. 13 and FIG. 14 illustrates an FR4 chip base 82 using a cylinder prism instead of a square prism.

The meandering radiating metal line 82 is formed on at least two surfaces of the FR4 chip base 81, and further comprises: a lower metal line 821; an upper metal line 822; and a connecting metal line 823.

On the other hand, a meandering radiating metal line not only can be formed on at least two surfaces of an FR4 chip base, but also can be formed on only one surface of the FR4 chip base, or inside the FR4 chip base.

In the aforementioned embodiments of the present invention, the size, pattern and location of each element forming a dual-band FR4 chip antenna are merely stated as the examples for explanation. Based on the actual needs and situations, the present invention may be adjusted accordingly, so that the present invention is not limited thereto.

Hence, an advantage of the present invention is to provide a dual-band FR4 chip antenna, and the dual-band FR4 chip antenna utilizes a low cost and sturdy FR4 material to replace a conventional ceramic chip antenna, and thus to overcome the disadvantages of the conventional ceramic chip antenna. A chip antenna designed by the present invention has the features of low cost, good performance and sturdiness, and also can be fabricated in different patterns and forms in accordance with actual needs, and can further achieve various dual-frequency operations by properly adjusting the length of the meandering radiating metal line and the meandering pattern in which the meandering radiating metal line is formed, so that can be used in many communication systems.

The other advantage of the present invention is to provide a dual-band FR4 chip antenna, which is suitable for using the SMT for mass production, so that the cost for integrating with microwave circuits is lowered, and the product stability is enhanced. Therefore, the dual-band FR4 chip antenna of the present invention has considerably high industrial application value.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A dual-band chip antenna comprising:

a chip base;

a meandering radiating metal line formed on at least two opposite surfaces of said chip base for generating a first operating band and a second operating band;

a connecting point for connecting said meandering radiating metal line to a signal transmission line; and a microwave substrate for mounting said chip base and forming said signal transmission line, wherein said microwave substrate has a ground surface, and said ground surface is overlapped with a portion of the area underneath said dual-band chip antenna on said microwave substrate.

2. The dual-band chip antenna of claim 1, wherein a length of said meandering radiating metal line is about ¼λ(wavelength) of a central frequency of said first operating band.

3. The dual-band chip antenna of claim 1, wherein the central frequency of said first operating band and a central frequency of said second operating band are first two resonant frequencies of said meandering radiating metal line.

4. The dual-band chip antenna of claim 1, wherein a shape of said chip base is selected from a group consisting of a rectangular prism, a square prism and a cylinder.

5. The dual-band chip antenna of claim 1, wherein said meandering radiating metal line comprises:

a first segment formed on first surface of said chip base, and said first surface is oriented toward said connecting point;

a second segment formed on a second surface opposite to said first surface of said chip base; and a connecting segment for connecting said first segment and said second segment.

6. The dual-band chip antenna of claim 5, wherein said first segment comprises:

a substantially U-shaped segment having one end connected to one end of said connecting segment, and the other end connected to said transmission line.

7. The dual-band chip antenna of claim 5, wherein said second segment comprises:

a substantially U-shaped segment having one end connected to the other end of said connecting segment; and a substantially L-shaped segment on the same surface plane of said U-shaped segment of said second segment, having one end connected to the other end of said U-shaped segment of said second segment.

8. The dual-band chip antenna of claim 5, wherein a width of said meandering radiating metal line is variable while forming on said chip base.

9. A dual-band chip antenna comprising:

a chip base;

a meandering radiating metal line formed on at least two opposite surfaces of said chip base for generating a first operating band and a second operating band, having a length of about ¼λ(wavelength) of a central frequency of said first operating band;

a connecting point for connecting said meandering radiating metal line to a signal transmission line; and a microwave substrate for mounting said chip base and forming said signal transmission line, wherein said microwave substrate has a ground surface, and said ground surface is overlapped with a portion of the area underneath said dual-band chip antenna on said microwave substrate.

10. The dual-band chip antenna of claim 9, wherein the central frequency of said first operating band and a central frequency of said second operating band are first two resonant frequencies of said meandering radiating metal line.

11. The dual-band chip antenna of claim 9, wherein a shape of said chip base is selected from a group consisting of a rectangular prism, a square prism and a cylinder.

12. The dual-band chip antenna of claim 9, wherein said meandering radiating metal line comprises:

a substantially U-shaped segment formed on a first surface of said chip base, having one end connected to said transmission line, and said first surface is oriented toward said connecting point;

a substantially U-shaped segment formed on a second surface opposite to said first surface of said chip base;

a substantially L-shaped segment on the same surface plane of said substantially U-shaped segment, having one end connected to one end of said substantially U-shaped segment formed on said second surface; and a connecting segment for connecting the other end of said substantially U-shaped segment formed on said first surface to the other end of said substantially U-shaped segment formed on said second surface.

13. The dual-band chip antenna of claim 9, wherein a width of said meandering radiating metal line is variable while forming on said chip base.

* * * * *